US006161486A

United States Patent [19]

Boots

[11] Patent Number: 6,161,486

[45] Date of Patent: Dec. 19, 2000

[54] FOLDABLE AND EXTENDABLE BENCH

[76] Inventor: Andrew P. Boots, 4701 Le Beau Ct., Fremont, Calif. 94555

[21] Appl. No.: 09/439,331

[22] Filed: Nov. 12, 1999

[51] Int. Cl.[7] ..... A47B 5/00

[52] U.S. Cl. ..... 108/48; 108/33; 297/14

[58] Field of Search ..... 108/48, 47, 42, 108/33, 65, 69; 297/236, 120, 14; 312/242, 245, 246, 248

[56] References Cited

U.S. PATENT DOCUMENTS

| | | | |
|---|---|---|---|
| 480,799 | 8/1892 | Wilms | 108/33 X |
| 3,680,942 | 8/1972 | Davis | 108/48 X |
| 4,068,551 | 1/1978 | Kreitz | 108/48 X |
| 4,155,609 | 5/1979 | Skafte et al. | 108/48 X |
| 4,803,930 | 2/1989 | Crocoli | 108/48 |
| 5,469,794 | 11/1995 | Laderoute et al. | 108/48 |

FOREIGN PATENT DOCUMENTS

| | | | |
|---|---|---|---|
| 1264691 | 5/1961 | France | 108/33 |

*Primary Examiner*—Jose V. Chen

[57] ABSTRACT

A foldable and extendable bench for allowing users with limited space to have a full size work bench. The foldable and extendable bench includes includes an elongate wall-mounted support member, a main table member having a back end, a front end, an elongate hinge member securely fastened to the back end and securely fastened to the wall-mounted support member, an elongate flange attached to and extending along the back end of the main table member for horizontally disposing the main table member, a opening extending through the front end into an internal storage compartment of the main table member, a rib-like member securely disposed inside and near the front end of the main table member, a pair of height-adjustable main leg members hingedly attached to a bottom of the main table member and including threaded main leveler members, a extension table member being retractable in and extendable from the opening and having a back end, a front end, a top side, a bottom side, a groove in the bottom side near and along the length of the back side, and a recessed portion in the top side at the back end of the extension table member, and a pair of height adjustable secondary leg members hingedly attached to a bottom side of the extension table member.

19 Claims, 3 Drawing Sheets

FOLDABLE AND EXTENDABLE BENCH

BACKGROUND OF THE INVENTION

1. Field of the Invention

The present invention relates to a wall-mounted, collapsible work bench and more particularly pertains to a new foldable and extendable bench for allowing users with limited space to have a full size work bench.

2. Description of the Prior Art

The use of a wall-mounted, collapsible work bench is known in the prior art. More specifically, a wall-mounted, collapsible work bench heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,322,022; U.S. Pat. No. 5,513,574; U.S. Pat. No. 2,650,145; U.S. Pat. No. 1,142,404; U.S. Pat. No. 1,796,635; and U.S. Pat. No. Des. 344,869.

While these devices fulfill their respective, particular objectives and requirements, the aforementioned patents do not disclose a new foldable and extendable bench. The inventive device includes an elongate wall-mounted support member, a main table member having a back end, a front end, an elongate hinge member securely fastened to the back end and securely fastened to the wall-mounted support member, an elongate flange attached to and extending along the back end of the main table member for horizontally disposing the main table member, a opening extending through the front end and into an internal storage compartment of the main table member, a rib-like member securely disposed inside and near the front end of the main table member, a pair of height-adjustable main leg members hingedly attached to a bottom of the main table member and including threaded main leveler members, a extension table member being retractable in and extendable from the opening and having a back end, a front end, a top side, a bottom side, a groove in the bottom side near and along the length of the back side, and a recessed portion in the top side at the back end of the extension table member, and a pair of height adjustable secondary leg members hingedly attached to a bottom side of the extension table member.

In these respects, the foldable and extendable bench according to the present invention substantially departs from the conventional concepts and designs of the prior art, and in so doing provides an apparatus primarily developed for the purpose of allowing users with limited space to have a full size work bench.

SUMMARY OF THE INVENTION

In view of the foregoing disadvantages inherent in the known types of a wall-mounted, collapsible work bench now present in the prior art, the present invention provides a new foldable and extendable bench construction wherein the same can be utilized for allowing users with limited space to have a full size work bench.

The general purpose of the present invention, which will be described subsequently in greater detail, is to provide a new foldable and extendable bench apparatus and method which has many of the advantages of the a wall-mounted, collapsible work bench mentioned heretofore and many novel features that result in a new foldable and extendable bench which is not anticipated, rendered obvious, suggested, or even implied by any of the prior art a wall-mounted, collapsible work bench, either alone or in any combination thereof.

To attain this, the present invention generally comprises includes an elongate wall-mounted support member, a main table member having a back end, a front end, an elongate hinge member securely fastened to the back end and securely fastened to the wall-mounted support member, an elongate flange attached to and extending along the back end of the main table member for horizontally disposing the main table member, a opening extending through the front end into an internal storage compartment of the main table member, a rib-like member securely disposed inside and near the front end of the main table member, a pair of height-adjustable main leg members hingedly attached to a bottom of the main table member and including threaded main leveler members, a extension table member being retractable in and extendable from the opening and having a back end, a front end, a top side, a bottom side, a groove in the bottom side near and along the length of the back side, and a recessed portion in the top side at the back end of the extension table member, and a pair of height adjustable secondary leg members hingedly attached to a bottom side of the extension table member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foldable and extendable bench apparatus and method which has many of the advantages of the a wall-mounted, collapsible work bench mentioned heretofore and many novel features that result in a new foldable and extendable bench which is not anticipated, rendered obvious, suggested, or even implied by any of the prior art a wall-mounted, collapsible work bench, either alone or in any combination thereof.

It is another object of the present invention to provide a new foldable and extendable bench which may be easily and efficiently manufactured and marketed.

It is a further object of the present invention to provide a new foldable and extendable bench which is of a durable and reliable construction.

An even further object of the present invention is to provide a new foldable and extendable bench which is susceptible of a low cost of manufacture with regard to both materials and labor, and which accordingly is then susceptible of low prices of sale to the consuming public, thereby making such foldable and extendable bench economically available to the buying public.

Still yet another object of the present invention is to provide a new foldable and extendable bench which provides in the apparatuses and methods of the prior art some of the advantages thereof, while simultaneously overcoming some of the disadvantages normally associated therewith.

Still another object of the present invention is to provide a new foldable and extendable bench for allowing users with limited space to have a full size work bench.

Yet another object of the present invention is to provide a new foldable and extendable bench which includes includes an elongate wall-mounted support member, a main table member having a back end, a front end, an elongate hinge member securely fastened to the back end and securely fastened to the wall-mounted support member, an elongate flange attached to and extending along the back end of the main table member for horizontally disposing the main table member, a opening extending through the front end and into an internal storage compartment of the main table member, a rib-like member securely disposed inside and near the front end of the main table member, a pair of height-adjustable main leg members hingedly attached to a bottom of the main table member and including threaded main leveler members, a extension table member being retractable in and extendable from the opening and having a back end, a front end, a top side, a bottom side, a groove in the bottom side near and along the length of the back side, and a recessed portion in the top side at the back end of the extension table member, and a pair of height adjustable secondary leg members hingedly attached to a bottom side of the extension table member.

Still yet another object of the present invention is to provide a new foldable and extendable bench that is convenient and easy to setup and use.

Even still another object of the present invention is to provide a new foldable and extendable bench that can be made into a full size workbench quickly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
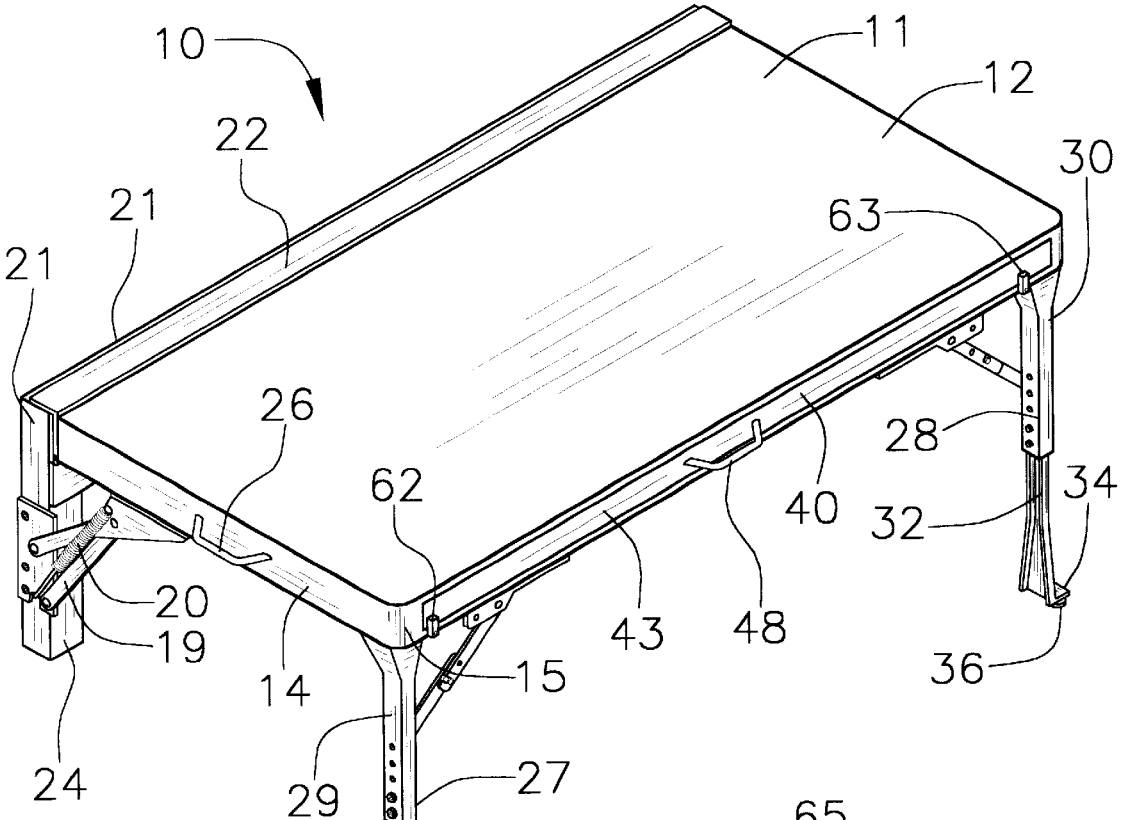
FIG. 1 is a perspective view of a new foldable and extendable bench according to the present invention.
Figure 2:
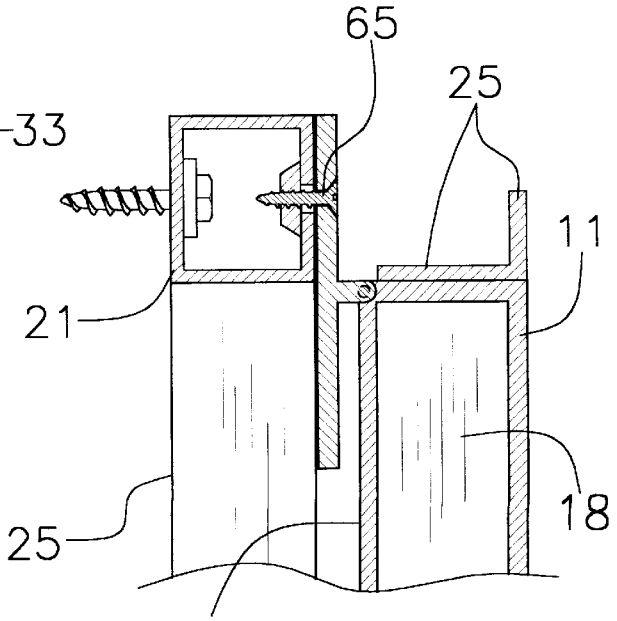
FIG. 2 is a detailed cross-sectional view of the wall-mounted support member and the main table member of the present invention.
Figure 3:
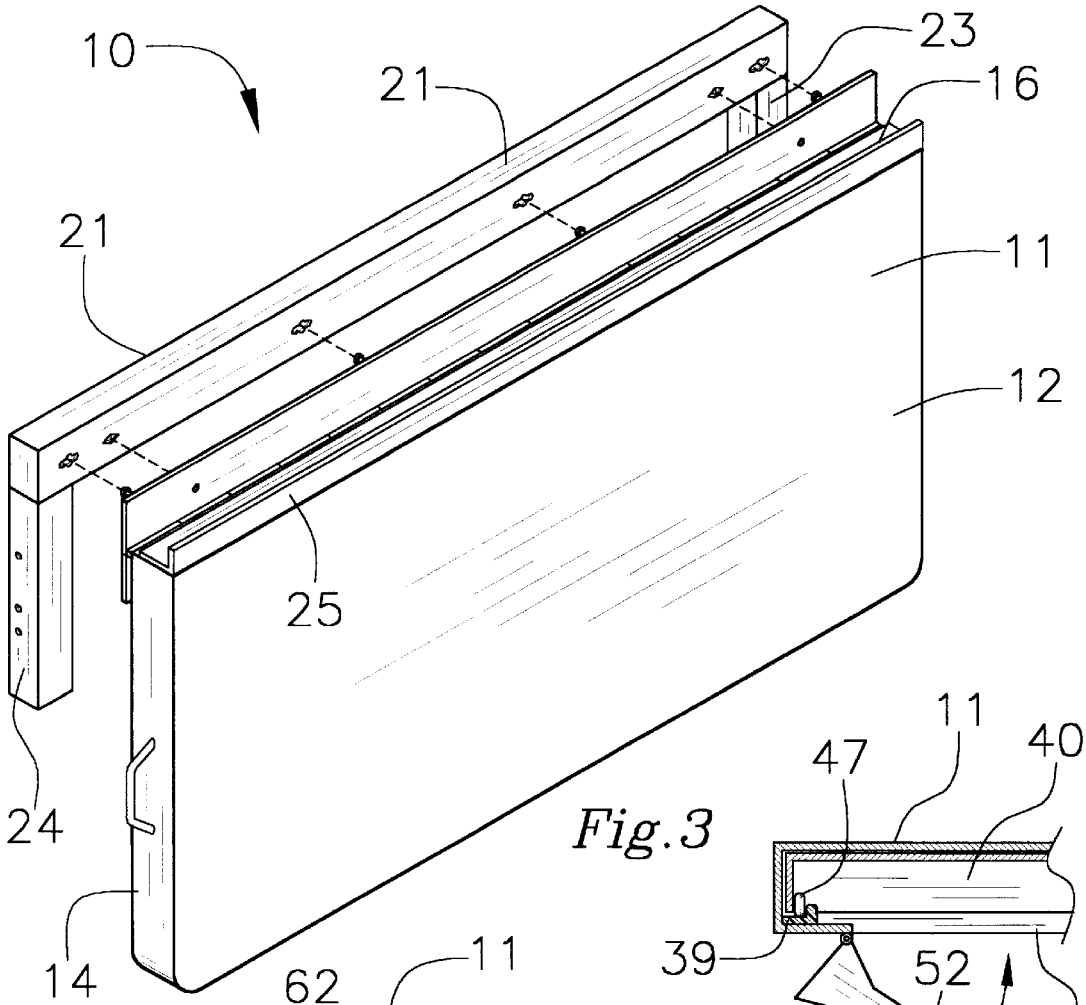
FIG. 3 is an exploded perspective view of the present invention when folded or collapsed.
Figure 5:
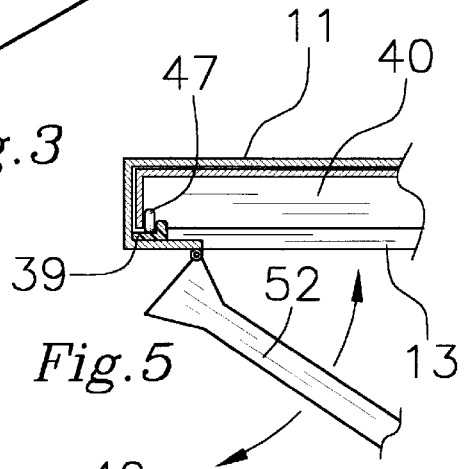
FIG. 5 is a detailed front view of a height-adjustable main leg member being folded.
Figure 4:
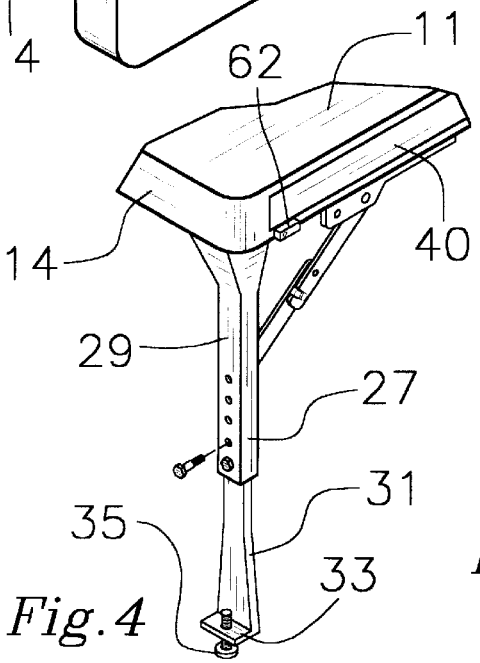
FIG. 4 is a detailed perspective view of a height-adjustable leg member of the present invention.
Figure 6:
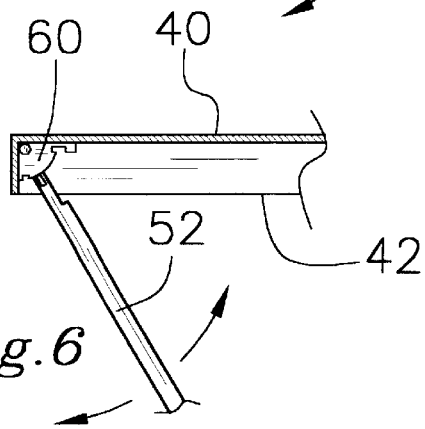
FIG. 6 is a detailed front view of the height-adjustable secondary leg member being folded.
Figure 7:
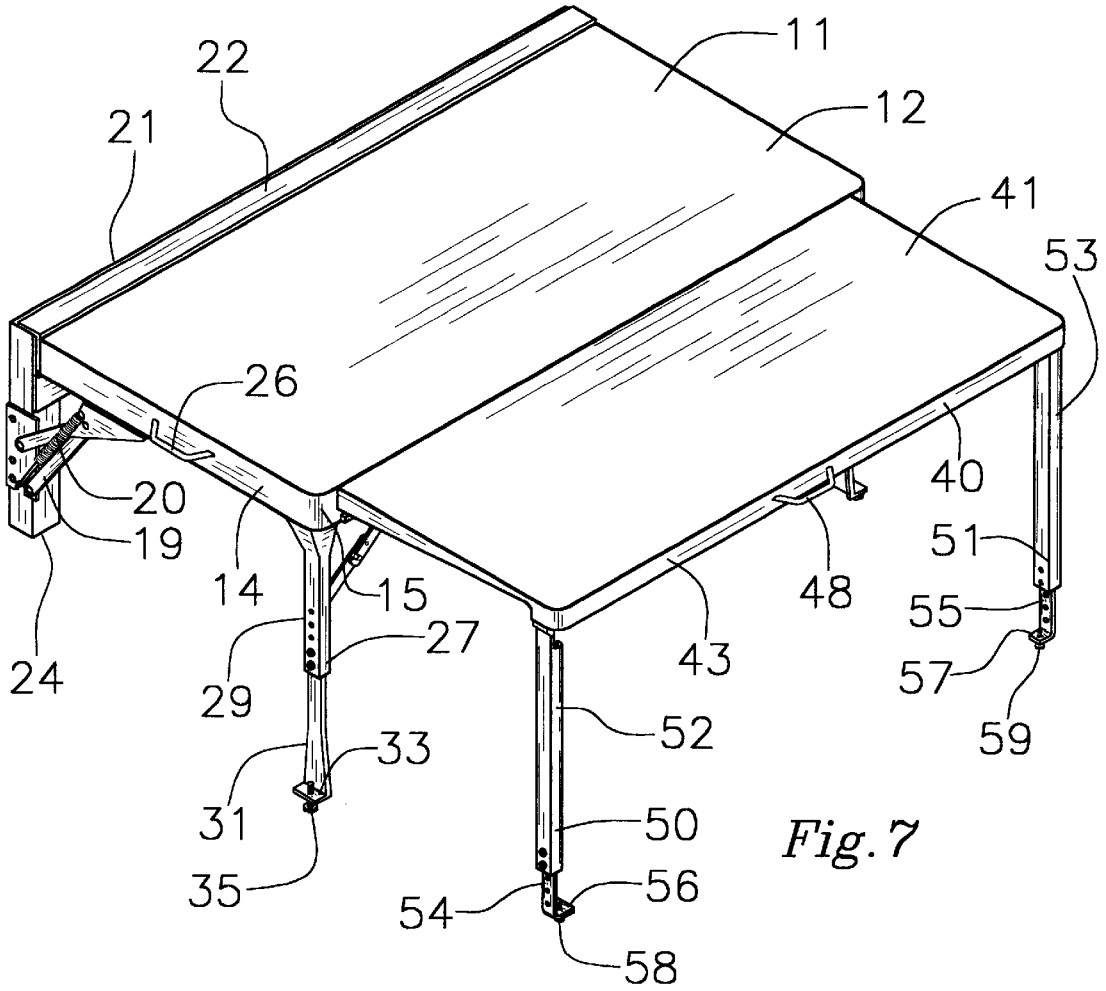
FIG. 7 is a perspective view of the present invention
Figure 8:
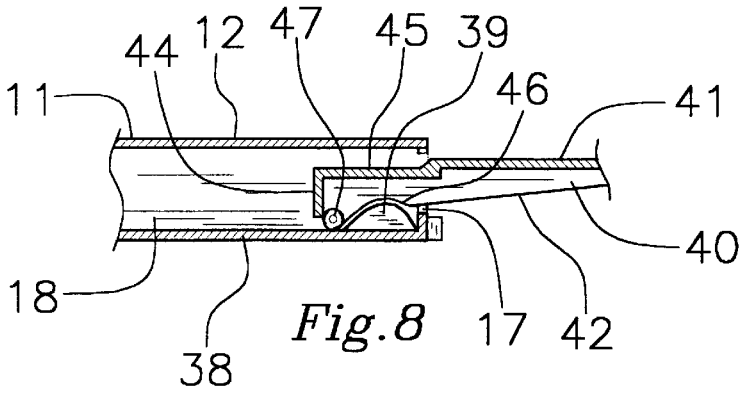
FIG. 8 is a detailed cross-sectional view of the main table member and the extension table member of the present invention.

With reference now to the drawings, and in particular to FIGS. 1 through 8 thereof, a new foldable and extendable bench embodying the principles and concepts of the present invention and generally designated by the reference numeral 10 will be described.

As best illustrated in FIGS. 1 through 8, the foldable and extendable bench 10 generally comprises a wall-mounted support member 21 having an elongate member 22 and a pair of depending members 23,24 securely and conventionally attached to ends of the elongate member 22, and being adapted to be securely fastened with screws to a wall structure.

The foldable and extendable bench 10 further comprises a main table member 11 having a flat top side 12, a back end 16, a front end 15, side ends 14, a bottom side 13, an internal storage compartment 18, an opening 17 extending through the front end 15 into the storage compartment 18, and an elongate flange 25 securely fastened with screws to the back end and extending the length thereof for horizontally disposing the main table member 11. The main table member 11 is hingedly attached, spring-loaded, and braced to the wall-mounted support member 21. The main table member 21 includes a handle member 26 securely and conventionally attached to one of the side ends 14, and also includes two pivotal latching members 62,63 being securely and conventionally attached to the front side 15 of the main table member 11 for securing the extension table member 40 inside the storage compartment 18. The latching members 62,63 are disposed so as to pivot over the opening 17 of the main table member 11. The main table member 11 also includes a rib-like member 39 securely and conventionally disposed on a bottom wall 38 of the main table member 11 inside the storage compartment 18 near the opening 17 for lifting the extension table member 40 such that the top sides 12,41 of both the main table member 11 and the extension table member 40 are essentially flush to one another.

A pair of height-adjustable main leg members 27,28 are hingedly attached and braced with screws to the bottom side 13 of the main table member 11. Each of the pair of height-adjustable main leg members 27,28 includes an elongate main member 29,30 having an end hingedly attached and braced to the bottom side 13 of the main table member 11, and an elongate extension member 31,32 having a foot portion 33,34 at one end and being extendably fastened with bolts to the elongate main member 29,30 for adjustment therealong, and a threaded leveler member 35,36 being threaded up through a bottom of the foot portion 33,34 for adjustably leveling the main table member 11.

The extendable and foldable bench 10 also includes an extension table member 40 having a top side 41, a front side 43, a back side 44, and a bottom side 42, and being retractable in and extendable from the storage compartment 18 through the opening 17 of the main table member 11. The extension table member 40 includes a laterally curved notch 46 extending in the bottom side 42 near the back end 44. The extension table member 40 further includes a narrow recessed portion 45 in the top side 41 extending forward a short distance from the back side 44 and extending the length of the back side 44. The extension table member 40 also includes a roller member 47 rotatably disposed in the bottom side 42 at the back end 44 for moving upon the rib-like member 39 to lift the extension table member 40 such that the top side 41 of the extension table member 40 is essentially flush with the top side 12 of the main table member 11. The extension table member 40 further includes a handle member 48 securely and conventionally attached to the front end 43 thereof.

A pair of height-adjustable secondary leg member 50,51 are pivotally and lockingly attached with screws to the bottom side 42 of the extension table member 40. Each height-adjustable secondary leg member 50,51 include an elongate main member 52,53 having an end pivotally and lockingly attached to a bracket member 60 which is securely attached to the bottom side 42 of the extension table member 40, and an elongate extension member 54,55 having a foot portion 56,57 at one end and being extendably fastened with bolts to the elongate main member 52,53, and a threaded leveler member 58,59 being threaded up through a bottom of the foot portion 56,57 for adjustably leveling the extension table member 40.

A brace means 19 is used to support the main table member 11 in a horizontal position and includes an end securely attached to the wall-mounted support member 21 and further includes another end securely attached to the bottom side 13 of the main table member 11 near the back end 16 thereof. A spring means 19 having ends connected to the wall-mounted support member 21 and to the main table member 11 is used to urge the folding of the main table member 11.

In use, the user raises the main table member 11 and unfolds the height-adjustable main leg members 27,28 so that the main table member 11 is disposed in a horizontal position. The user then pivots the latching members 62,63 away from the opening 17 in the main table member 11 and grasps the handle member 26 of the extension table member 40 and urges the extension table member 40 out of the storage compartment 18 and unfolds the height-adjustable secondary leg members 50,51 so that the extension table member 40 is disposed in a horizontal position and flush with the main table member 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An extendable and foldable bench comprising:

a wall-mounted support member having an elongate member, and a pair of depending members securely attached to ends of said elongate member, and being adapted to be securely fastened to a wall structure;

a main table member having a flat top side, a back end, a front end, side ends, a bottom side, an internal storage compartment, a opening extending through said front end into said storage compartment, and an elongate flange securely fastened to said back end and extending the length thereof for coupling to said wall-mounted support member such that said main table member is horizontally disposed from said wall-mounted table member, said main table member being hingedly attached, spring-loaded, and braced to said wall-mounted support member;

a pair of height-adjustable main leg members being hingedly attached and braced to said bottom side of said main table member;

an extension table member having a top side, a front side, a back side, and a bottom side, and being retractable in and extendable from said storage compartment through said opening of said main table member;

a pair of height-adjustable secondary leg members being hingedly attached to said bottom side of said extension table member; and a brace means having an end securely attached to said wall-mounted support member and having another end securely attached to said bottom side of said main table member near said back end thereof for supporting said main table member in a horizontal position, and also includes a spring means having ends connected to said wall-mounted support member and to said main table member for urging the folding of said main table member.

2. An extendable and foldable bench as described in claim 1, wherein said main table member includes a handle member securely attached to one of said side ends, and also includes pivotal latching members being securely attached to said front side of said main table member for securing said extension table member inside said storage compartment, said latching members are disposed so as to pivot over said opening of said main table member.

3. An extendable and foldable bench as described in claim 1, wherein each of said pair of height-adjustable main leg members includes an elongate main member having an end hingedly attached and braced to said bottom side of said main table member, and an elongate extension member having a foot portion at one end and being extendably fastened to said elongate main member, and a threaded leveler member being threaded up through a bottom of said foot portion for adjustably leveling said main table member.

4. An extendable and foldable bench as described in claim 1, wherein said main table member includes at least one rib-like member securely disposed on a bottom wall of said main table member inside said storage compartment near said opening for lifting said extension table member such that said top sides of both said main table member and said extension table member are essentially flush to one another.

5. An extendable and foldable bench as described in claim 4, wherein said extension table member includes at least one laterally curved notch extending in said bottom side near said back end.

6. An extendable and foldable bench as described in claim 5, wherein said extension table member further includes a narrow recessed portion in said top side extending forward from said back side and extending the length of said back side.

7. An extendable and foldable bench as described in claim 6, wherein said extension table member also includes at least one roller member rotatably disposed in said bottom side at said back end for moving upon said at least one rib-like member to lift said extension table member such that said top side of said extension table member is essentially flush with said top side of said main table member.

8. An extendable and foldable bench as described in claim 7, wherein said extension table member further includes a handle member securely attached to said front end thereof.

9. An extendable and foldable bench as described in claim 7, wherein each of said height-adjustable secondary leg members includes an elongate main member having an end hingedly and lockingly attached to a bracket member securely attached to said bottom side of said extension table member, and an elongate extension member having a foot portion at one end and being extendably fastened to said elongate main member, and a threaded leveler member being threaded up through a bottom of said foot portion for adjustably leveling said extension table member.

10. An extendable and foldable bench comprising:

a wall-mounted support member having an elongate member, and a pair of depending members securely attached to ends of said elongate member, and being adapted to be securely fastened to a wall structure;

a main table member having a flat top side, a back end, a front end, side ends, a bottom side, an internal storage compartment, a opening extending through said front end into said storage compartment, and an elongate flange securely fastened to said back end and extending the length thereof for coupling to said wall-mounted support member such that said main table member is horizontally disposed from said wall-mounted table member, said main table member being hingedly attached, spring-loaded, and braced to said wall-mounted support member, said main table member including a handle member securely attached to one of said side ends, and also including pivotal latching members being securely attached to said front side of said main table member for securing said extension table member inside said storage compartment, said latching members being disposed so as to pivot over said opening of said main table member, said main table member also including at least one rib-like member securely disposed on a bottom wall of said main table member inside said storage compartment near said opening for lifting said extension table member such that said top sides of both said main table member and said extension table member are essentially flush to one another;

a pair of height-adjustable main leg members being hingedly attached and braced to said bottom side of said main table member; each of said pair of height-adjustable main leg members including an elongate main member having an end hingedly attached and braced to said bottom side of said main table member, and an elongate extension member having a foot portion at one end and being extendably fastened to said elongate main member, and a threaded leveler member being threaded up through a bottom of said foot portion for adjustably leveling said main table member;

an extension table member having a top side, a front side, a back side, and a bottom side, and being retractable in and extendable from said storage compartment through said opening of said main table member, said extension table member including a laterally curved notch extending in said bottom side near said back end, said extension table member further including a narrow recessed portion in said top side extending forward from said back side and extending the length of said back side, said extension table member also including at least one roller member rotatably disposed in said bottom side at said back end for moving upon said rib-like member to lift said extension table member such that said top side of said extension table member is essentially flush with said top side of said main table member, said extension table member further including a handle member securely attached to said front end thereof;

a pair of height-adjustable secondary leg member being hingedly attached to said bottom side of said extension table member, each of said height-adjustable secondary leg members including an elongate main member having an end hingedly and lockingly attached to a bracket member securely attached to said bottom side of said extension table member, and an elongate extension member having a foot portion at one end and being extendably fastened to said elongate main member, and a threaded leveler member being threaded up through a bottom of said foot portion for adjustably leveling said extension table member; and a brace means having an end securely attached to said wall-mounted support member and having another end securely attached to said bottom side of said main table member near said back end thereof for supporting said main table member in a horizontal position, and also including a spring means having ends connected to said wall-mounted support member and to said main table member for urging the folding of said main table member.

11. An extendable and foldable bench comprising:

a wall-mountable support member having an elongate member, and a pair of depending members attached to ends of said elongate member, and being adapted to be fastened to a wall structure;

a main table member having a flat top side, a back end, a front end, side ends, a bottom side, an internal storage compartment, a opening extending through said front end into said storage compartment, and an elongate flange fastened to said back end and extending the length thereof for coupling to said support member such that said main table member is horizontally disposed from said main table member, said main table member being hingedly attached, spring-loaded, and braced to said support member;

a pair of height-adjustable main leg members being hingedly attached and braced to said bottom side of said main table member;

an extension table member having a top side, a front side, a back side, and a bottom side, and being retractable in and extendable from said storage compartment through said opening of said main table member;

a pair of height-adjustable secondary leg members being hingedly attached to said bottom side of said extension table member; and a brace having an end attached to said support member and having another end securely attached to said bottom side of said main table member near said back end thereof for supporting said main table member in a horizontal position, said brace also including a spring having ends connected to said support member and to said main table member for urging the folding of said main table member.

12. An extendable and foldable bench as described in claim 11, wherein said main table member includes a handle member securely attached to one of said side ends, and also includes pivotal latching members being securely attached to said front side of said main table member for securing said extension table member inside said storage compartment, said latching members are disposed so as to pivot over said opening of said main table member.

13. An extendable and foldable bench as described in claim 11, wherein each of said pair of height-adjustable main leg members includes an elongate main member having an end hingedly attached and braced to said bottom side of said main table member, and an elongate extension member having a foot portion at one end and being extendably fastened to said elongate main member, and a threaded leveler member being threaded up through a bottom of said foot portion for adjustably leveling said main table member.

14. An extendable and foldable bench as described in claim 11, wherein said main table member includes at least one rib-like member securely disposed on a bottom wall of said main table member inside said storage compartment near said opening for lifting said extension table member such that said top sides of both said main table member and said extension table member are essentially flush to one another.

15. An extendable and foldable bench as described in claim 14, wherein said extension table member includes at least one laterally curved notch extending in said bottom side near said back end.

16. An extendable and foldable bench as described in claim 15, wherein said extension table member further includes a narrow recessed portion in said top side extending forward from said back side and extending the length of said back side.

17. An extendable and foldable bench as described in claim 16, wherein said extension table member also includes at least one roller member rotatably disposed in said bottom side at said back end for moving upon said at least one rib-like member to lift said extension table member such that said top side of said extension table member is essentially flush with said top side of said main table member.

18. An extendable and foldable bench as described in claim 17, wherein said extension table member further includes a handle member securely attached to said front end thereof.

19. An extendable and foldable bench as described in claim 17, wherein each of said height-adjustable secondary leg members includes an elongate main member having an end hingedly and lockingly attached to a bracket member securely attached to said bottom side of said extension table member, and an elongate extension member having a foot portion at one end and being extendably fastened to said elongate main member, and a threaded leveler member being threaded up through a bottom of said foot portion for adjustably leveling said extension table member.

* * * * *